US005880397A

United States Patent [19]

Crilly

[11] Patent Number: 5,880,397

[45] Date of Patent: Mar. 9, 1999

[54] SELECTABLE CARTRIDGE

[75] Inventor: Michael Gerard Crilly, Hatboro, Pa.

[73] Assignee: Scientific Solutions Inc., Hatboro, Pa.

[21] Appl. No.: 956,088

[22] Filed: Oct. 23, 1997

[51] Int. Cl.[6] ..... F42B 5/00; F42B 5/16

[52] U.S. Cl. ..... 102/443; 102/430; 102/470

[58] Field of Search ..... 102/430, 432, 102/439, 443, 448, 466, 467, 469, 470

[56] References Cited

U.S. PATENT DOCUMENTS

| | | |
|---|---|---|
| 3,283,719 | 11/1966 | Grandy . |
| 4,619,202 | 10/1986 | Romer et al. . |
| 5,400,715 | 3/1995 | Roach et al. . |

FOREIGN PATENT DOCUMENTS

| | | | |
|---|---|---|---|
| 1372175 | 8/1964 | France | 102/430 |
| 2398282 | 3/1979 | France | 102/443 |
| 253867 | 4/1926 | United Kingdom | 102/443 |

*Primary Examiner*—Harold J. Tudor

[57] ABSTRACT

A selectable cartridge is provided consisting of a cartridge head, a dual-bed propellant chamber, a primer, and a tube. The invention enables the user to select a launch velocity prior to chambering the round. A high-velocity projectile is launched by mechanically rotating the base cap and rotation band such that holes along the primer align with the larger of two propellant beds. A low-velocity projectile is launched by rotating the base cap and rotating band a quarter turn from the high-velocity setting such that the holes along the primer align now align with the smaller propellant bed. The invention is suited for use in shotguns.

9 Claims, 3 Drawing Sheets

SELECTABLE CARTRIDGE

Cross References to Related Applications

None.

FIELD OF INVENTION

This invention concerns a shotgun cartridge which facilitates the selective initiation of one of two propellant beds, thereby determining the launch velocity of the projectile.

BACKGROUND OF THE INVENTION

Shotgun cartridges fall into two broad yet distinct categories. The first category includes designs which launch dense-metal bullets or projectiles at velocities typically greater than 300 meters-per-second. The second category consists of designs which launch lower-density bullets, projectiles, and aggregate filled bags at velocities typically lower than 150 meters-per-second. Cartridge design optimizes launch velocity within a category to maximize the desired terminal effects, namely, lethal penetration at high velocity and non-lethal impact at low velocity. Single-velocity cartridge designs severely limit the utility of ammunition. More importantly, single-velocity designs fix the response level of the user irrespective of the threat or situation.

Adjustable velocity ammunition is confined to large caliber shells. These inventions include rigidly-attached, segmented propellant beds and various selection mechanisms.

Grandy U.S. Pat. No. 3,283,719, 1966 describes a multi-bed propellant chamber to achieve multi-range capability irrespective of gun barrel length. A plurality of independent propellant charges are arranged in eccentric beds with respect to the longitudinal axis of the shell. The effective range of the projectile is increased by increasing the number of charges ignited. This design suffers four deficiencies. First, the eccentric arrangement of propellant charges produces an asymmetric pressure field which promotes damage to the projectile. Second, a plurality of primers are required to ignite the several propellant charges thereby making the design incompatible with single-point, centered firing pins employed in conventional gun systems. Third, the disc used to shield non-initiated propellant beds from the ignited charge is likely to remain in the gun barrel thereby interfering with the firing cycle. And fourth, noninitiated propellant charges are susceptible to temperature buildup leading to its undesired ignition. This problem is pronounced where the propellant bed, shell case, and gun breach are in close proximity. This deficiency precludes application of Grandy type devices to weapons with high rates of fire where the gun breach is subjected to extreme temperature elevations.

Romer U.S. Pat. No. 4,619,202, 1986 describes another multi-bed propellant chamber which achieves multi-range capability. Two or more independent circular propellant charges are arranged coaxially with respect to the longitudinal axis of the shell casing. Mechanical initiation of the lower most propellant bed is achieved by a firing pin. Electrical initiation via an electronics circuit allows for selective ignition of a plurality of propellant beds thus achieving the desired velocity. Propellant beds are mechanically secured in series with the base of the projectile. This invention suffers from three deficiencies. First, the coaxial arrangement and construction of the propellant beds is prone to generating debris which in turn enters the gun barrel thereby interfering with the firing cycle. Second, attachment of the propellant beds to the projectile to facilitate the transport of the non-initiated beds from the gun barrel adds parasitic mass and alters the aerodynamic characteristics of the projectile. Both events adversely impact projectile performance in terms of reduced range and altered flight dynamics. And third, reliance on an electronic ignition circuit to achieve selectability precludes use in conventional handguns, shotguns, and rifles which employ a mechanical firing pin.

As is apparent from the inventions above, neither facilitates the following: a mechanically-based selector mechanism housed within a sealed cartridge; a selector mechanism based on a rotatable multi-chamber propellant bed; a selector mechanism compatible with single-pin firing systems and based on a single, mechanically initiated primer; and a selector design and propellant bed arrangement which result in the debris free ignition of a single propellant bed.

It is therefore the primary object of this invention to provide a selectable cartridge that:

A. Provides the mechanical selection of one of two propellant beds thereby facilitating either a low-velocity or a high-velocity launch.

B. Incorporates a single primer system compatible with conventional firing pins.

C. Incorporates a coaxial bed arrangement in which a low-velocity bed and a high-velocity bed are contained in a single unit operating in a debris-free fashion.

D. Incorporates a propellant bed arrangement in which a thermally insulated high-velocity bed remains in the cartridge after discharge of the low-velocity bed.

E. Incorporates a propellant bed arrangement which is launched with the projectile from the barrel when the high-velocity bed is discharge thereby functioning as the wad in a conventional shotgun round and expelling the non-initiated propellant contained in the low-velocity bed.

F. Maintains the optimum flight characteristics of the projectile.

SUMMARY OF THE INVENTION

A selectable cartridge comprising a cartridge head, dual-bed propellant chamber, primer, tube, and propellant fill are arranged such that the user is facilitated the mechanical selection of a single propellant bed. A smaller propellant bed adjacent to the projectile facilitates a low-velocity launch. A larger propellant bed towards the lower end of the cartridge facilitates a high-velocity launch.

The two-piece construction of the cartridge head provides the mechanical rotation system which facilitates the counter-rotational motion required to align the primer and one of two propellant beds such that only one bed is ignited.

The single-unit construction of the dual-bed propellant chamber provides several functions. First, it facilitates the ignition path to the appropriate propellant bed. Second, it thermally insults the propellant in the high-velocity bed which remains in the cartridge after discharge of the low-velocity bed. Third, it shields the noninitiated propellant bed from that ignited. Fourth, it functions as a wad thereby providing a seal between the gun barrel and launch package so that the expanding gas produced by the high-velocity bed efficiently accelerates the projectile. And fifth, it transports the non-initiated propellant charge in the low-velocity bed from the gun barrel.

REFERENCE NUMERALS

Figure 1:
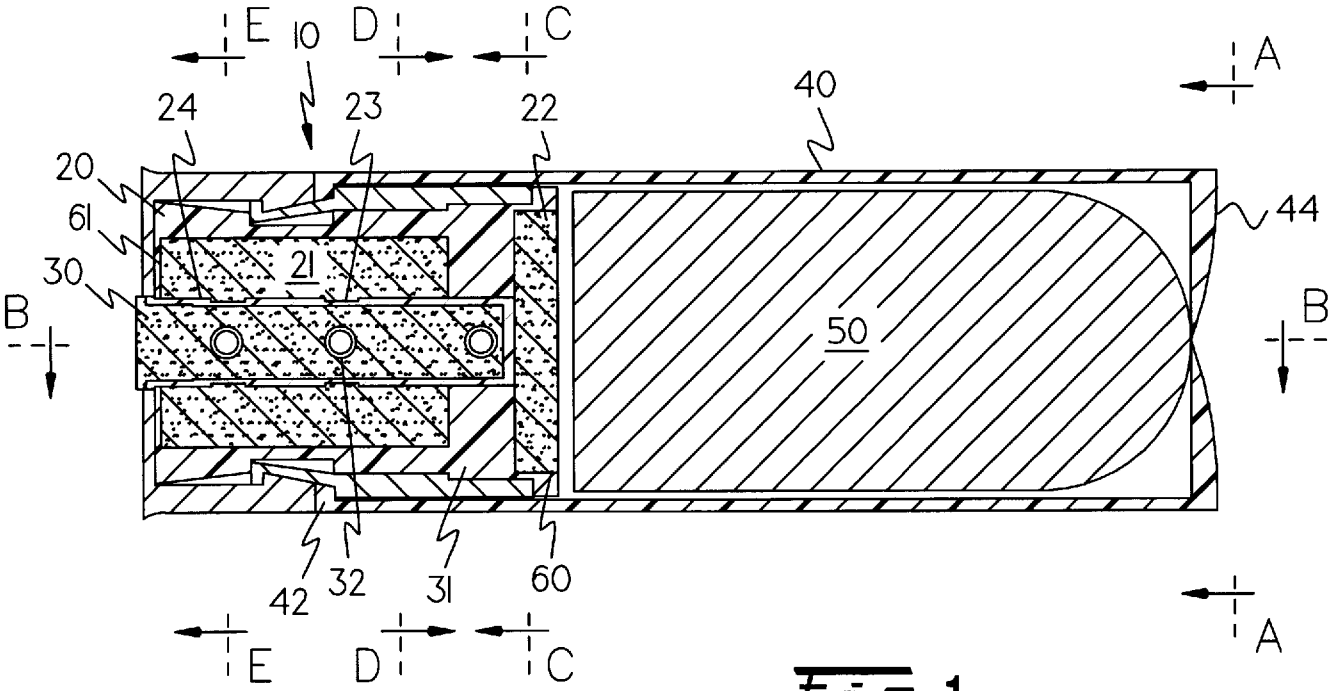
FIG. 1 is a longitudinal cross section view of the invention.

10 Cartridge head
11 Rotation channel
12 Rotation band
13 Rotation lock notch
14 Base cap
15 Rim
16 Lower rotational flange
17 Upper rotational flange
18 Primer hole
19 Interlock channel
20 Dual-bed propellant chamber
21 High-velocity bed
22 Low-velocity bed
23 Ignition cover
24 Primer shroud
25 Propellant bed bulkhead
26 Interlock tab
27 Exterior wall
28 Gas seal ring
29 Ignition suppression bulkhead lower cavity
31 Ignition suppression bulkhead upper cavity
30 Primer
32 Flash hole
40 Tube
42 Flange
44 Frangible cover
46 Rotation lock tab
50 Projectile
60 Propellant cavity upper
61 propellant cavity lower
62 Combustible cover

DESCRIPTION OF THE INVENTION

Figure 2:
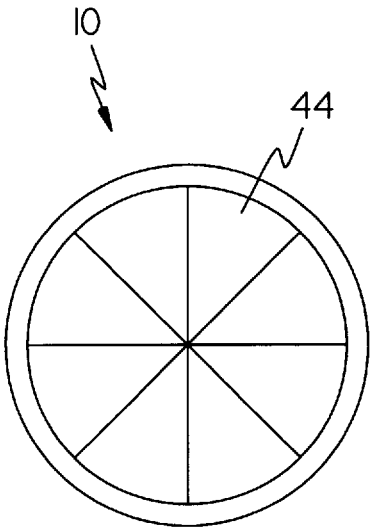
FIG. 2 is a cross section on line AA showing a top view of the invention.

FIG. 1 shows the selectable cartridge assembly. The cartridge consists of a cartridge head 10, a dual-bed propellant chamber 20, a primer 30, and a tube 40. A projectile 50 is positioned within the tube 40 thereby contacting the dual-bed propellant chamber 20. The projectile 50 may take any form and shape required for the application. The projectile 50 is secured with a frangible cover 44 at one end of the tube 40. The frangible cover 44 also provides an environmental seal for interior of the selectable cartridge. The tube 40 is constructed from plastics practiced by those skilled in the art. The frangible cover 44 is formed using conventional crimping techniques known to those in the art. FIG. 2 shows one such embodiment, an eight-fold crimp. Two propellant cavities lower 61 within the high-velocity bed 21 and one propellant cavity upper 60 within the low-velocity bed 22 are housed within the dual-bed propellant chamber 20. FIGS. 4 through 7 show the location of the propellant charges within the propellant cavity upper 60 and propellant cavity lower 61. Charges may consist of any formulation required for the application.

Figure 3:
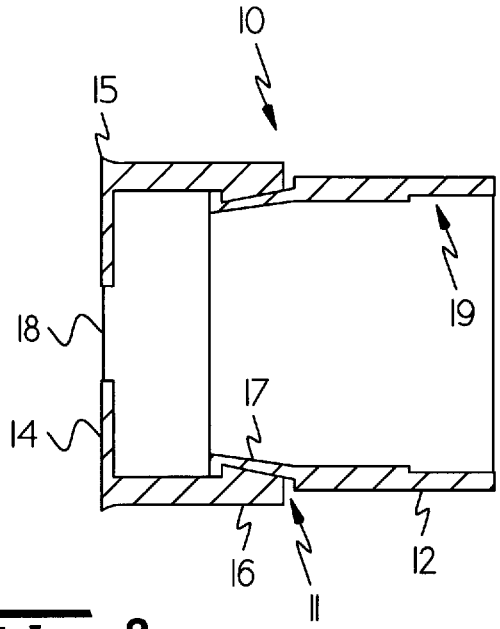
FIG. 3 is a longitudinal cross section on line BB showing the cartridge head.

FIG. 3 shows the cartridge head 10. The cartridge head 10 consists of a rotation band 12 and base cap 14. The rotation band 12 and base cap 14 consist of a metal. The preferred embodiments consist of brass, steel, and aluminum. The most preferred embodiment is brass. The base cap 14 contains a lower rotational flange 16, a primer hole 18 at the opposite end to accommodate a primer 30, and a rim 15. The rim 15 is a circular flange at the end opposite the lower rotational flange 14. It serves as a positive stop when the cartridge is inserted into the gun breach. The primer 30 is compression loaded into the primer hole 18 thereby attaching it to the base cap 14 so that both rotate as a single unit. The rotation band 12 contains an upper rotational flange 17 and an interlock channel 19. The base cap 14 and rotation band 12 are assembled by compression loading the items such that the lower rotational flange 16 and upper rotational flange 17 engage. A rotation channel 11 is provided between base cap 14 and rotation band 12 along the exterior circumference of the cartridge head 10 adjacent to the lower rotational flange 16 and upper rotational flange 17. This feature accommodates the flange 42 at the one end of the tube 40. This arrangement allows the base cap 14 to rotate independently from the rotation band 12. The interlock channel 19 consists of two narrow grooves along the inside of the rotation band 12 offset by 180 degrees. The interlock channels 19 accommodate the two interlock tabs 26 on the dual-bed propellant chamber 20. This arrangement secures the rotation of the dual-bed propellant chamber 20 to the rotation band 12.

The rotation band 12 is of smaller diameter than the base cap 14. The tube 40 is secured to the outside circumferential surface of the rotation band 12. Attachment is achieved by an adhesive, threading, or the direct molding of the tube 40 onto the rotation band 12. The outer diameter of the tube 40 is no greater than the outer diameter of the cylindrical portion of the base cap 14. The flange 42 serves several functions: it further secures the tube 40 to the rotation band 12; it provides a gas seal thereby preventing leakage of combustion products from the cartridge; it facilitates rotation by providing a sliding surface between the rotation band 12 and base cap 14; and it facilitates the assembly of the rotation band 12 and base cap 14 by providing a positive stop during the compression assembly of the cartridge head 10.

Figure 8:
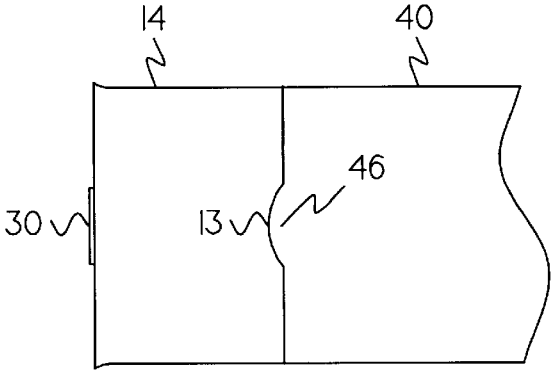
FIG. 8 is a longitudinal view of the rotation lock notch and tab.

The rotational motion of the cartridge head 10 is secured by means of four rotation lock notches 13 on the base cap 14 and four rotation lock tabs 46 on the flange 42 of the tube 40. FIG. 8 shows one such pair of rotation lock notches 13 and rotation lock tabs 46 in the locked position. The rotation lock notches 13 and rotation lock tabs 46 are set at 90 degree intervals around the circumference of the cartridge head 10. The depth of the rotation lock notch 13 and thickness of the rotation lock tab 46 is sufficient to prevent inadvertent rotation of the cartridge head 10 yet facilitate rotational motion where desired.

The primer 30 contains a plurality of flash holes 32 which communicate the ignition train to one of two propellant beds. Primer 30 construction is that practiced by those in the art. Flash holes 32 are aligned along the length of the primer 30 forming two lines which are symmetric with respect to the longitudinal axis of the primer 30. The flash holes 32 align with the location of one pair of rotation lock notches 13 and rotation lock tabs 46.

Figure 4:
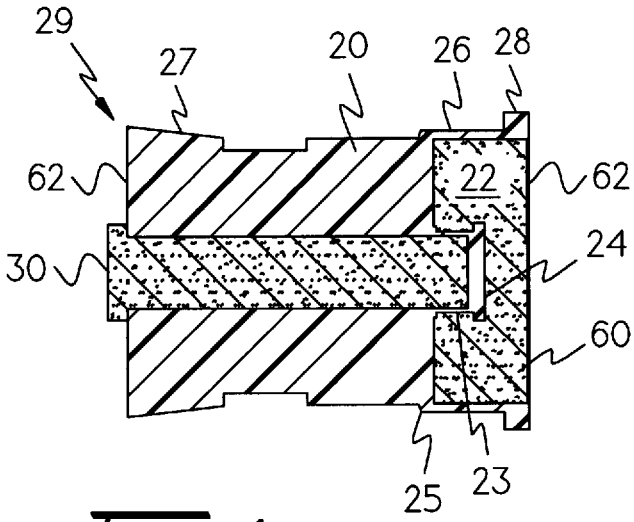
FIG. 4 is a longitudinal cross section on line BB showing the dual-bed propellant chamber.
Figure 5:
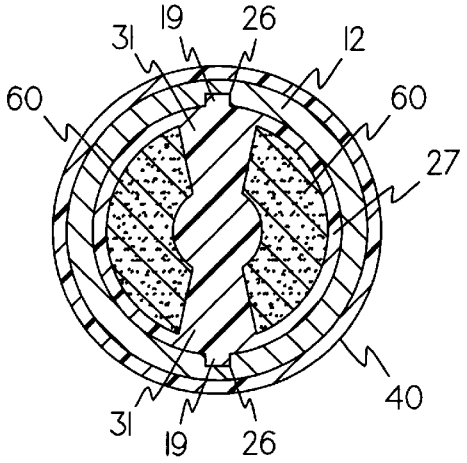
FIG. 5 is a cross section on line CC showing features of the low-velocity bed.
Figure 6:
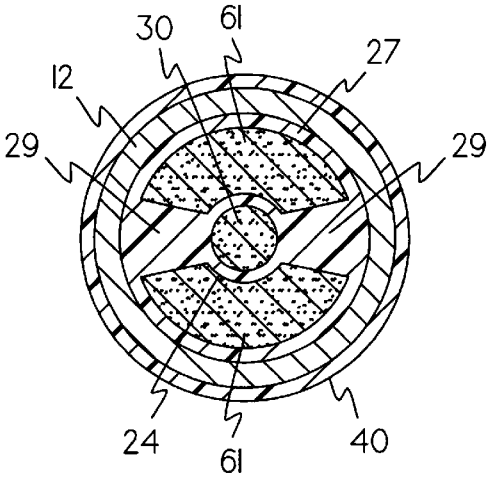
FIG. 6 is a cross section on line DD showing the upper features of the high-velocity bed.

Two views along the longitudinal axis of the dual-bed propellant chamber 20 are shown in FIGS. 1 and 4. The dual-bed propellant chamber 20 consists of a single piece-plastic unit fabricated by methods known to those skilled in the art of machining, injection molding, and extruding. The preferred embodiments is comprised of polyethylene or polypropylene. The most preferred embodiment is polypropylene. Critical features include a high-velocity bed 21, a low-velocity bed 22, a plurality of ignition covers 23, a primer shroud 24, a propellant bed bulkhead 25, two interlock tabs 26, an exterior wall 27, a gas seal ring 28, two ignition suppression bulkheads lower cavity 29, and two ignition suppression bulkheads upper cavity 31. The high-velocity bed 21 consists of two symmetric cavities divided by two ignition suppression bulkheads 29. The ignition suppression bulkheads upper cavity 31 and the primer shroud 24 extend into the low-velocity bed 22. Both beds are further divided by the propellant bed bulkhead 25 of sufficient thickness to shield the non-initiated bed from that which is initiated. Both beds are shielded from the primer 30 by the primer shroud 24. The primer shroud 24 forms a sealed cavity along the longitudinal axis of the dual-bed propellant chamber 20. The exterior wall 27 further shields the propellant cavity lower 61 and propellant cavity upper 60 in the adjacent beds from unintended ignition by either exposure to combustion products or heat flow from the gun breach during high cycle rates. The exterior wall 27 must be sufficiently flexible to facilitate its compression assembly into the cartridge head 10 and to allow its ejection from the gun barrel when the high-velocity bed 21 is ignited. The wall profile is such that it conforms to the interior of the cartridge head 10. The lowermost end is angled to facilitate separation of the dual-bed propellant chamber 20 from the cartridge head 10. The gas ring seal 28 is a circular flange at the uppermost end of the dual-bed propellant chamber 20 adjacent to the projectile 50. This item provides a positive stop during compression assembly of the dual-bed propellant chamber 20 into the cartridge head 10. Its primary function is as a gas seal. During combustion of the propellant charge in the low-velocity bed 22, the gas seal ring 28 compresses against the rotation band 12 thus shielding the high-velocity bed 21. During combustion of the propellant charges in the high-velocity bed 21, the gas seal ring 28 contacts the gun barrel so that combustion products do not reach the propellant charge in the low-velocity bed 22. Combustible covers 62 are glued or mechanically attached to both ends of the dual-bed propellant chamber 20. Combustible covers 62 are either kraft paper or thin metal foil. These covers further shield the propellant charge in one bed from the combustion products from another. Additionally, they contain the propellant charge within the dual-bed propellant chamber 20 during assembly with the cartridge head 10.

Figure 7:
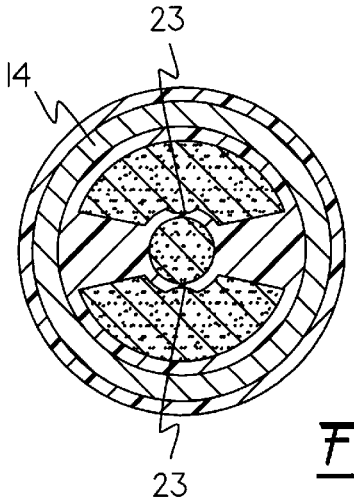
FIG. 7 is a cross section on line EE showing the lower features of the high-velocity bed.

The high-velocity bed 21 is of greater volume than the low-velocity bed 22 as required to achieve the desired launch velocities. The low-velocity bed 22 resides adjacent to the projectile 50. The high-velocity bed 21 and ignition suppression bulkheads lower cavity 29 are offset at a 90 degree angle with respect to the low-velocity bed 22 and its ignition suppression bulkheads upper cavity 31. In the high-velocity bed 21, a plurality of ignition covers 23 lie along two lines offset by 180 degrees along the longitudinal length of the primer shroud 24 in a symmetric pattern. In the low-velocity bed 22, two ignition covers 23 are offset by 180 degrees along the length of the primer shroud 24. Ignition covers 23 are formed by reducing the wall thickness of the primer shroud 24 such that ignition products from the primer 30 perforate the wall and ignite the propellant charge. FIGS. 1, 4, and 7 show the ignition covers 23. The ignition covers 23 in the high-velocity bed 21 and low-velocity bed 22 are offset at a 90 degree angle. Ignition covers 23 coincide with the location of flash holes 32 in the primer 30. The above described arrangement of the high-velocity bed 21, low-velocity bed 22, ignition suppression bulkheads lower cavity 29, ignition suppression bulkheads upper cavity 31 and ignition covers 23 facilitates the alignment of flash holes 32 with the ignition covers 23 in one propellant bed and the ignition suppression bulkheads of another bed at any given time. The result is the communication of the burn train in the primer 30 with the propellant charge in only one bed.

Operation

Velocity selection is accomplished by the mechanical rotation of the base cap 14 and rotation band 12. Rotation of the base cap 14 aligns the flash holes 32 along the primer 30 with the appropriate ignition cover 23 and propellant bed. A quarter turn changes the functional mode of the round. The round is subsequently chambered in the weapon.

In the high-velocity mode, the flash holes 32 are rotated to align with the ignition covers 23 in the high-velocity bed 21 and the ignition suppression bulkheads upper cavity 31 in the low-velocity bed 22. When the hammer on the weapon strikes the primer 30, the powder in the primer 30 burns projecting combustion products from the flash holes 32 which perforate the ignition covers 23 along the primer shroud 24 thus igniting the propellant charges in the high-velocity bed 21. The combustion products propel the dual-bed propellant chamber 20 and projectile 50 from the tube 40 after breaking the frangible cover 44. The gas seal ring 28 travels along the gun barrel thereby insuring the efficient acceleration of the projectile 50. The low-velocity bed 22 and propellant charge are ejected from the gun barrel without ignition.

In the low-velocity mode, the flash holes 32 are rotated to align with the ignition covers 23 in the low-velocity bed 22 and the ignition suppression bulkheads lower cavity 29 in the high-velocity bed 21. When the gun hammer strikes the primer 30, the powder in the primer 30 burns projecting combustion products from the flash holes 32 which perforate the ignition covers 23 along the primer shroud 24 thus igniting the propellant charge in the low-velocity bed 22. The combustion products propel the projectile 50 from the tube 40 after breaking the frangible cover 44. The gas seal ring 28 is compressed into the rotation band 12. The high-velocity bed 21 and its propellant charge remain intact within the cartridge head 10.

Industrial Applicability

Accordingly, it can be seen that the invention facilitates not only a dual level of response by law enforcement or military personnel against hostile threats but variable range inherent to velocity adjustment. In the realm of dual response, the invention enables the user to project a bullet or projectile with lethal effects where it would otherwise be non-lethal. The primary advantage of this invention is a fully mechanical selector mechanism which tailors the projectile velocity. Also it is important to note that the cartridge design and function is compatible with existing weapons. The concept is ideally suited to a smoothbore, 12-gauge shotgun.

Although the description above contains many specificities, these should not be construed as limiting the scope of the invention but as merely providing illustrations of some of the presently preferred embodiments of this invention. Various other embodiments and ramifications are possible. For example, the invention is suited to the launch of a incendiary projectile. In this application, both beds could contain equal amounts of propellant. The front bed would be ignited to launch the projectile such that its incendiary core burns. The back bed would be ignited to the launch the projectile in its inert condition.

Thus the scope of the invention should be determined by the appended claims and their legal equivalents, rather than by the examples given.

What is claimed is:

1. A selectable cartridge, for launching a projectile at more than one velocity, comprising:

(a) a cartridge head, said cartridge head comprising a base cap and a rotation band, said base cap having a primer rigidly attached to one end, said base cap having a rim at same end, said rotation band attached to the opposite end of said base cap so to freely rotate around the longitudinal axis of said cartridge head, said rotation band of smaller diameter than said base cap;

(b) a dual-bed propellant chamber, said dual-bed propellant chamber having a high-velocity bed, a low-velocity bed, a primer shroud, a propellant bed bulkhead, a plurality of interlock tabs, a pair of ignition suppression bulkheads lower cavity, a pair of ignition suppression bulkheads upper cavity an exterior wall, a gas seal ring, a plurality of ignition covers along said primer shroud, said low-velocity bed lies between a projectile and said high-velocity bed, said high-velocity bed is of greater volume than said low-velocity bed, said pair of ignition suppression bulkheads lower cavity divide said high-velocity bed forming two propellant cavities, said pair of ignition suppression bulkheads upper cavity reside in said a lower portion of low-velocity bed to form one said propellant cavity said propellant cavities each filled with a propellant charge, said low-velocity bed arranged axially with respect to said high-velocity bed such that said pair of ignition suppression bulkheads lower cavity is offset at 90 degrees with respect to said pair of ignition suppression bulkheads upper cavity and further separated by said propellant bed bulkhead, said interlock tabs on said dual-bed propellant chamber attach to a plurality of interlock channels on said rotation band thereby securing the rotation of said dual-bed propellant chamber to said rotation band, said interlock tabs and said interlock channels oriented longitudinally with respect to said selectable cartridge, said exterior wall positioned in and contacting said cartridge head, said exterior wall of sufficient thickness to facilitate its separation from said cartridge head when said high-velocity bed is ignited, said gas seal ring attached to said dual-bed propellant chamber and adjacent to said projectile said gas ring seal having an outer diameter at least that of the inner diameter of the gun barrel, said ignition covers are less thick than the wall forming said primer shroud to facilitate perforation by combustion products from said flash holes said ignition covers are aligned in two symmetric rows offset at 180 degrees, two ignition covers located within said low-velocity bed and offset from said ignition covers along said high-velocity bed by 90 degrees;

(c) said primer surrounded by said primer shroud, said primer and said primer shroud located in both said low-velocity bed and said high-velocity bed, said primer shroud attached to said dual-bed propellant chamber, said primer having a plurality of flash holes symmetrically aligned about the longitudinal axis of said cartridge head to form two lines said flash holes aligned with two rotation lock notches on said base cap, said flash holes coincide with the location of ignition covers along said primer shroud; and (d) a tube, said tube attached to said cartridge head, said tube having an outer diameter no greater than a diameter of said base cap.

2. The selectable cartridge of claim 1 wherein said rotation band and said base cap are composed of a metal the attachment between said items achieved by a lower rotational flange on said base cap and an upper rotational flange on said rotation band.

3. The selectable cartridge of claim 1 wherein said rotation band and said base cap are composed of a metal selected from the group consisting of brass, steel, and aluminum.

4. The selectable cartridge of claim 1 wherein said rotation band and said base cap are composed of brass.

5. The selectable cartridge of claim 1 further comprising four rotation lock notches on said base cap and four rotation lock tabs on said tube both positioned at 90 degree intervals as to secure the rotation of said cartridge head.

6. The selectable cartridge of claim 1 wherein said dual-bed propellant chamber is composed a thermoplastic selected from the group consisting of polyethylene and polypropylene.

7. The selectable cartridge of claim 1 wherein said dual-bed propellant chamber is composed of polypropylene.

8. The selectable cartridge of claim 1 wherein said dual-bed propellant chamber ends are covered by a combustible cover selected from the group consisting of kraft paper and metal foil.

9. The selectable cartridge of claim 1 wherein said tube is comprised of a thermoplastic having a frangible cover at one end and attached to said rotation band by a means selected from the group consisting of an adhesive, threading, and direct molding.

* * * * *